US011554927B2

(12) United States Patent
Ishifune

(10) Patent No.: US 11,554,927 B2
(45) Date of Patent: Jan. 17, 2023

(54) SHEET CONVEYANCE APPARATUS AND IMAGE FORMING APPARATUS

(71) Applicant: CANON KABUSHIKI KAISHA, Tokyo (JP)

(72) Inventor: Taro Ishifune, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 371 days.

(21) Appl. No.: 16/570,233

(22) Filed: Sep. 13, 2019

(65) Prior Publication Data

US 2020/0102171 A1 Apr. 2, 2020

(30) Foreign Application Priority Data

Sep. 28, 2018 (JP) ..... JP2018-185895

(51) Int. Cl.

| | |
|---|---|
| ***B65H 85/00*** | (2006.01) |
| ***B65H 7/00*** | (2006.01) |
| ***B65H 29/20*** | (2006.01) |
| ***B65H 29/68*** | (2006.01) |
| ***B65H 5/06*** | (2006.01) |

(52) U.S. Cl.

CPC ..... *B65H 7/00* (2013.01); *B65H 5/06* (2013.01); *B65H 29/20* (2013.01); *B65H 29/68* (2013.01)

(58) Field of Classification Search

CPC . B65H 85/00; B65H 7/00; B65H 5/06; B65H 29/20; B65H 29/68

See application file for complete search history.

(56) References Cited

U.S. PATENT DOCUMENTS

| | | | |
|---|---|---|---|
| 9,296,585 | B2 | 3/2016 | Yamada |
| 9,656,819 | B2 | 5/2017 | Yamada |
| 10,005,630 | B2 | 6/2018 | Shiina et al. |

(Continued)

FOREIGN PATENT DOCUMENTS

| | | | |
|---|---|---|---|
| JP | H11-322165 | A | 11/1999 |
| JP | 2007-119236 | A | 5/2007 |
| JP | 2010-215377 | A | 9/2010 |

(Continued)

OTHER PUBLICATIONS

Machine translation of JP2017-119559 (Year: 2017).*

Japanese Office Action dated Aug. 23, 2022, in related Japanese Patent Application No. 2018-185895.

*Primary Examiner* — Thomas A Morrison

(74) *Attorney, Agent, or Firm* — Venable LLP

(57) ABSTRACT

A sheet conveyance apparatus includes a switching member to execute a pivot operation and a conveyance portion to convey a sheet at a first conveyance speed where a driving motor rotates at a first rotational speed, and to convey the sheet at a second conveyance speed which is greater than zero and slower than the first conveyance speed where the driving motor rotates at a second rotational speed which is greater than zero and slower than the first rotational speed. Where a control portion conveys a first sheet at the first conveyance speed, the switching member executes the pivot operation at the second operating speed before the first sheet arrives at the switching member and the conveyance portion, and rotates the driving motor at the first rotational speed after the pivot operation has been executed and before the first sheet arrives at the conveyance portion.

11 Claims, 13 Drawing Sheets

(56) References Cited

U.S. PATENT DOCUMENTS

2015/0108715 A1* 4/2015 Yamada ..... B65H 5/062
271/272

FOREIGN PATENT DOCUMENTS

| | | | |
|---|---|---|---|
| JP | 2015-098399 | A | 5/2015 |
| JP | 2015-189579 | A | 11/2015 |
| JP | 2017-119559 | A | 7/2017 |

* cited by examiner

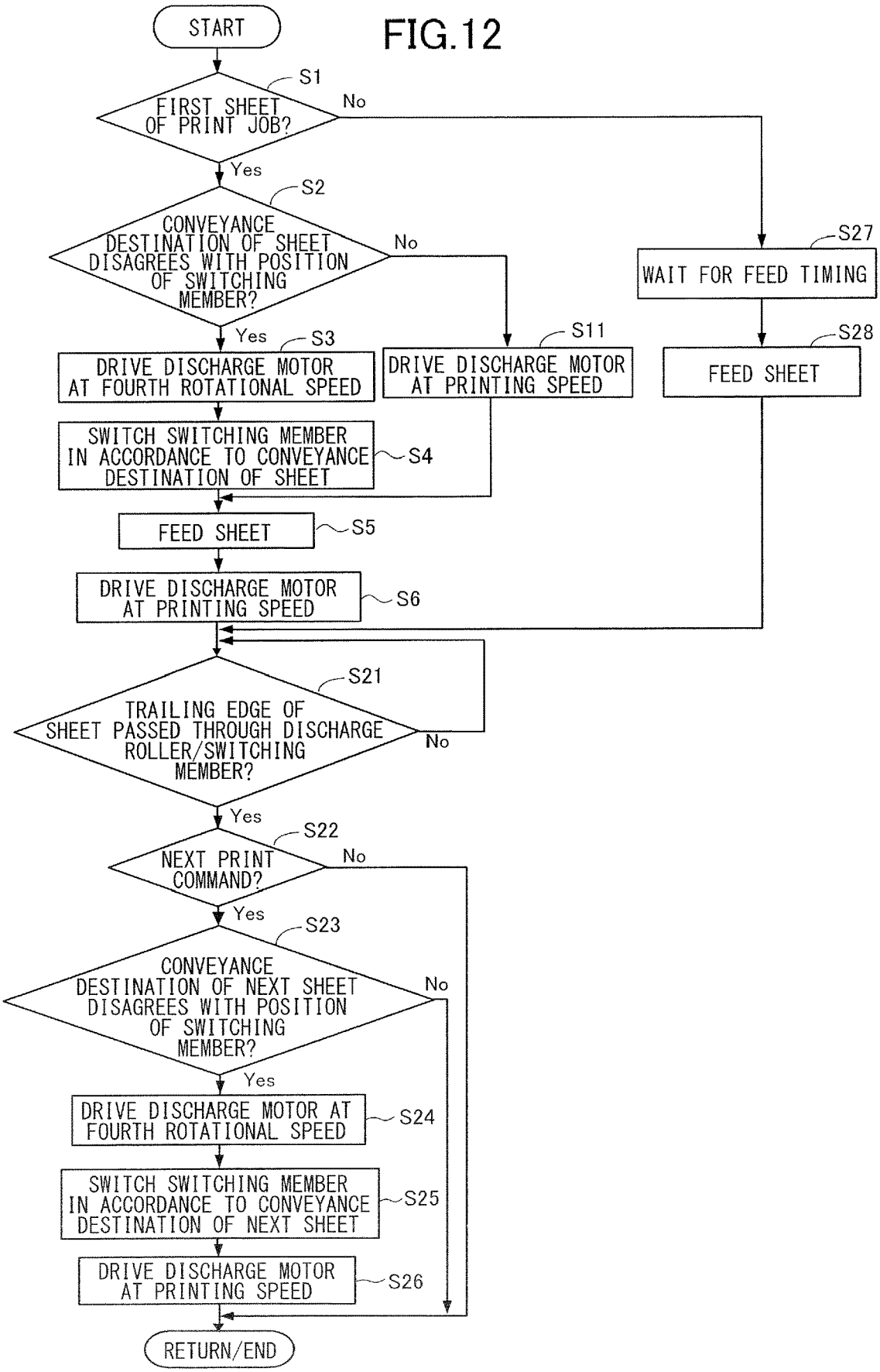
FIG.12
START
S1
FIRST SHEET OF PRINT JOB?
No
Yes
S2
CONVEYANCE DESTINATION OF SHEET DISAGREES WITH POSITION OF SWITCHING MEMBER?
No
Yes
S3
DRIVE DISCHARGE MOTOR AT FOURTH ROTATIONAL SPEED
S11
DRIVE DISCHARGE MOTOR AT PRINTING SPEED
S27
WAIT FOR FEED TIMING
S28
FEED SHEET
SWITCH SWITCHING MEMBER IN ACCORDANCE TO CONVEYANCE DESTINATION OF SHEET
S4
FEED SHEET
S5
DRIVE DISCHARGE MOTOR AT PRINTING SPEED
S6
S21
TRAILING EDGE OF SHEET PASSED THROUGH DISCHARGE ROLLER/SWITCHING MEMBER?
No
Yes
S22
NEXT PRINT COMMAND?
No
Yes
S23
CONVEYANCE DESTINATION OF NEXT SHEET DISAGREES WITH POSITION OF SWITCHING MEMBER?
No
Yes
DRIVE DISCHARGE MOTOR AT FOURTH ROTATIONAL SPEED
S24
SWITCH SWITCHING MEMBER IN ACCORDANCE TO CONVEYANCE DESTINATION OF NEXT SHEET
S25
DRIVE DISCHARGE MOTOR AT PRINTING SPEED
S26
RETURN/END

SHEET CONVEYANCE APPARATUS AND IMAGE FORMING APPARATUS

BACKGROUND OF THE INVENTION

Field of the Invention

The present invention relates to a sheet conveyance apparatus configured to convey a sheet, and an image forming apparatus including the same.

Description of the Related Art

Hitherto, there has been known a printer including a switching member configured to be movable between a first switching position for guiding a sheet to a sheet discharge conveyance path and a second switching position for guiding the sheet to a sheet reversing conveyance path as disclosed in Japanese Patent Application Laid-open No. 2017-119559 for example. The sheet guided to the sheet discharge conveyance path is discharged out of the apparatus and the sheet guided to the sheet reversing conveyance path is reversed such that an image is formed also on a back surface thereof. The switching member is switched between the first and second switching positions as a driving force of a driving motor is transmitted to the switching member by a solenoid that operates for a predetermined time while the driving motor rotates.

Lately, such a printer is required to improve its productivity and to reduce its noise. Then, while the driving motor described in Japanese Patent Application Laid-open No. 2017-119559 is sometimes used not only in switching the switching member but also in driving a sheet discharge roller pair for example. In such a case, operating sound of the switching member increases because the switching member also pivots in high speed if the driving motor is rotated in high speed to improve the productivity of the printer. Meanwhile, if the driving motor is rotated in low speed to reduce the noise of the printer, a sheet discharge speed drops because the sheet discharge roller pair rotates in low speed, thus dropping the productivity of the printer. Thus, it has been difficult to achieve both of the improvement of the productivity and the reduction of noise of the printer.

SUMMARY OF THE INVENTION

According to one aspect of the present invention, a sheet conveyance apparatus includes a switching member configured to be pivotable between a first position where the switching member guides a sheet to a first conveyance path and a second position where the switching member guides a sheet to a second conveyance path different from the first conveyance path, a conveyance portion configured to convey the sheet, a driving motor configured to drive the conveyance portion, a transmission unit configured to transmit rotations of the driving motor to the switching member to cause the switching member to execute a pivot operation of pivoting from either one of the first and second positions to the other of the first and second positions, and a control portion configured to control the driving motor and the transmission unit, wherein the conveyance portion conveys the sheet at a first conveyance speed in a case where the driving motor rotates at a first rotational speed, and conveys the sheet at a second conveyance speed which is slower than the first conveyance speed in a case where the driving motor rotates at a second rotational speed which is slower than the first rotational speed, wherein the switching member executes the pivot operation at a first operating speed in a case where the transmission unit transmits the rotations of the driving motor rotating at the first rotational speed to the switching member, and executes the pivot operation at a second operating speed which is slower than the first operating speed in a case where the transmission unit transmits the rotations of the driving motor rotating at the second rotational speed to the switching member, and wherein, in a case where the control portion conveys a first sheet in a job at the first conveyance speed by the conveyance portion and causes the switching member to execute the pivot operation, the control portion causes the switching member to execute the pivot operation at the second operating speed before the first sheet arrives at the switching member and the conveyance portion, and rotates the driving motor at the first rotational speed after the pivot operation has been executed and before the first sheet arrives at the conveyance portion.

Further features of the present invention will become apparent from the following description of exemplary embodiments with reference to the attached drawings.

BRIEF DESCRIPTION OF THE DRAWINGS

FIG. 12 is a flowchart illustrating a sheet conveyance control of a second embodiment.

DESCRIPTION OF THE EMBODIMENTS

First Embodiment

Overall Structure

Figure 1:
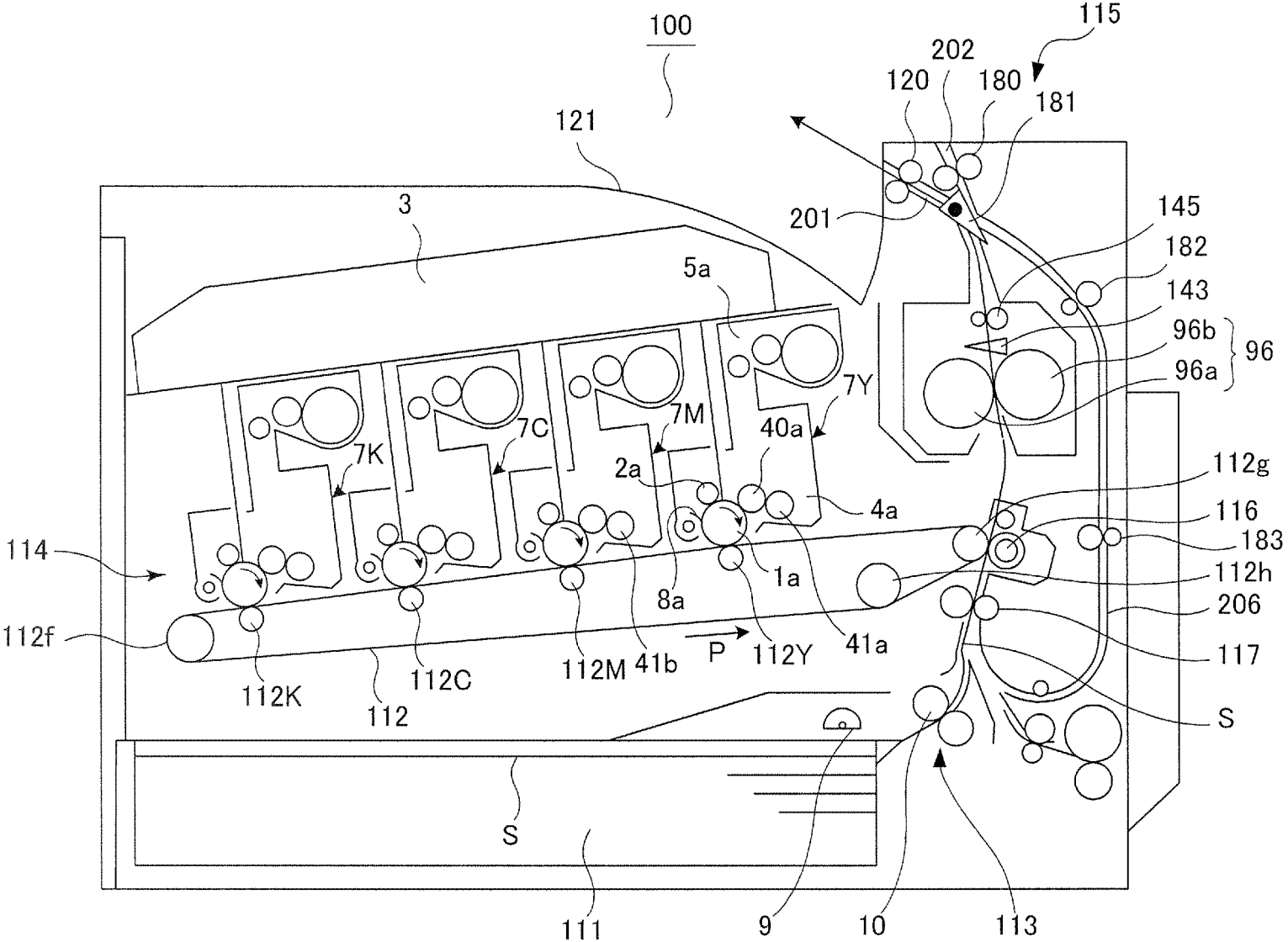
FIG. 1 is a schematic diagram illustrating an overall configuration of a printer of a first embodiment.

Firstly, a first embodiment of the present disclosure will be described. A printer 100 serving as an image forming apparatus is an electro-photographic full-color laser beam printer. As illustrated in FIG. 1, the printer 100 includes an image forming unit 114 forming an image on a sheet S, a sheet feed unit 113, a fixing roller pair 96 and a sheet discharge unit 115. The image forming unit 114 includes four process cartridges 7Y, 7M, 7C and 7K forming four color toner images of yellow (Y), magenta (M), cyan (C) and black (K), respectively, and a scanner unit 3.

Note that because the structures of the four process cartridges 7Y, 7M, 7C and 7K have the same structure other than that the colors of images to be formed are different, only the structure and an image forming process of the process cartridge 7Y will be described below and descriptions of the process cartridges 7M, 7C and 7K will be omitted.

The process cartridge 7Y includes a photosensitive drum 1*a*, a charging roller 2*a*, a cleaning blade 8*a* and a development unit 4*a*. The photosensitive drum 1*a* is composed of an organic photoconductive layer applied on an outer circumference of an aluminum cylinder and is rotated by a driving motor not illustrated. The development unit 4*a* includes a developing roller 40*a* and a developer applying roller 41*a* that applies developer on a peripheral surface of the developing roller 40*a*.

The image forming unit 114 is also provided with an intermediate transfer belt 112 stretched around a driving roller 112*f*, a tension roller 112*h* and a secondary transfer counter roller 112*g*. Primary transfer rollers 112Y, 112M, 112C and 112K are provided inside of the intermediate transfer belt 112. Still further, a secondary transfer roller 116 is provided so as to face the secondary transfer counter roller 112*g* and so as to sandwich the intermediate transfer belt 112. The intermediate transfer belt 112 and the secondary transfer roller 116 form a transfer nip where an image is formed on a sheet S conveyed thereto.

The sheet feed unit 113 includes a cassette 111 provided at a lower part of the printer 100 and supports the sheet S, a pickup roller 9 feeding the sheet S supported by the cassette 111 and a separation roller pair 10. The fixing roller pair 96 includes a fixing roller 96*a* and a pressure roller 96*b* formed respectively into a hollow shape. A heater not illustrated is built in the fixing roller 96*a*. The sheet discharge unit 115 includes a switching member 181, a discharge roller pair 120, a reversing roller pair 180 and others.

Next, an image forming operation of the printer 100 constructed as described above will be described. As an image signal is inputted to the scanner unit 3 from a personal computer or an image reading unit not illustrated, the scanner unit 3 irradiates the photosensitive drum 1*a* of the process cartridge 7Y with a laser beam corresponding to the image signal.

At this time, a surface of the photosensitive drum 1*a* has been homogeneously charged by the charging roller 2*a* with predetermined polarity and potential in advance, so that an electrostatic latent image is formed on the surface of the photosensitive drum 1*a* as the scanner unit 3 irradiates the photosensitive drum 1*a* with the laser beam. The electrostatic latent image formed on the photosensitive drum 1*a* is developed by the development unit 4*a* and is formed as a toner image of yellow (Y).

In the same manner, the scanner unit 3 irradiates the respective photosensitive drums of the process cartridges 7M, 7C and 7K with laser beams to form toner images of magenta (M), cyan (C) and black (K) on the respective drums. The toner images of the respective colors formed on the respective photosensitive drums are transferred onto the intermediate transfer belt 112 by primary transfer rollers 112Y, 112M, 112C and 112K and are conveyed to a transfer nip by the intermediate transfer belt 112 rotated by the driving roller 112*f*. Note that an image forming process of the respective colors are carried out at a timing of superimposing on the upstream toner image primarily transferred onto the intermediate transfer belt 112. Residual toner left on the photosensitive drum 7*a* is removed by the cleaning blade 8*a*.

In parallel with the image forming process, the sheet S stored in the cassette 111 of the sheet feed unit 113 is delivered out by the pickup roller 9 and is separated one by one by the separation roller pair 10. Then, a skew of the sheet S is corrected by a registration roller pair 117 and is conveyed with a predetermined conveyance timing matched with the image transfer timing at the transfer nip.

Then, a full color toner image on the intermediate transfer belt 112 is transferred onto the sheet S at the transfer nip by a secondary transfer bias applied to the secondary transfer roller 116. The sheet S onto which the toner image has been transferred is conveyed to the fixing roller pair 96 to be heated and pressed by the fixing roller 96*a* and the pressure roller 96*b* such that the toner melts and is fixed on the sheet S. The sheet S that has passed through the fixing roller pair 96 is conveyed by a sheet discharge conveyance roller pair 145 to the switching member 181.

Figure 2:
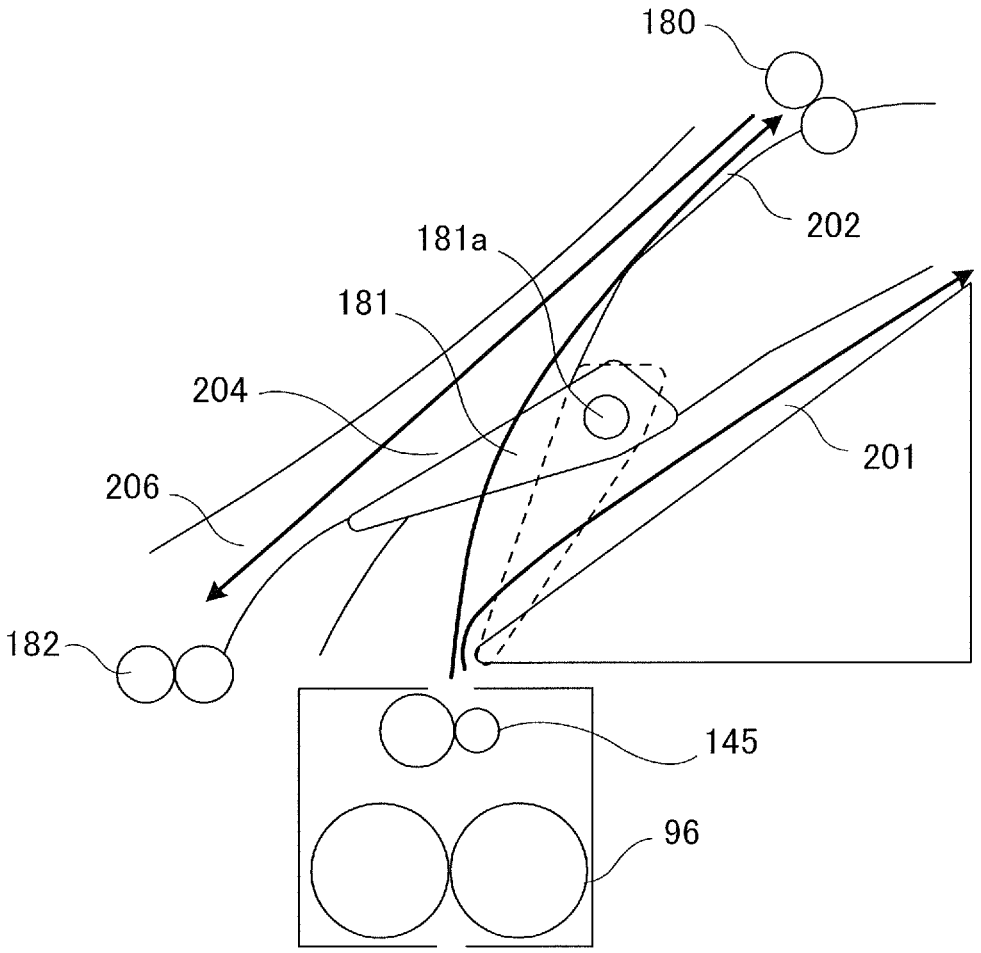
FIG. 2 is a side view illustrating a switching member.

As illustrated in FIG. 2, the switching member 181 is configured to be pivotable between a first position, i.e. a position indicated by a solid line, where the switching member 181 guides the sheet S conveyed by the sheet discharge conveyance roller pair 145 to a sheet discharge conveyance path 201 and a second position, i.e., a position indicated by a broken line, where the switching member 181 guides the sheet S to a reverse conveyance path 202. In a case where a simplex printing job of forming an image only on one surface is inputted, the switching member 181 is positioned at the first position and the sheet S is guided to the sheet discharge conveyance path 201 serving as a first conveyance path. The sheet S guided to the sheet discharge conveyance path 201 is discharged out of the apparatus by a discharge roller pair 120 and is stacked on a sheet discharge tray 121. The discharge roller pair 120 is disposed downstream of the switching member 181 in terms of a sheet conveyance direction.

In a case where a duplex printing job of forming images on both surfaces of the sheet S is inputted, the sheet Son which an image has been formed on one surface thereof at the transfer nip is guided to the reverse conveyance path 202 serving as a second conveyance path by the switching member 181 that is located at the second position. The reversing roller pair 180 provided along the reverse conveyance path 202 reversely rotates after when a trailing edge of the sheet S passes through the switching member 181 to switch-back the sheet S. During that time, the switching member 181 moves to the first position to guide the switch-backed sheet S to a duplex conveyance path 206.

The sheet S guided to the duplex conveyance path 206 is conveyed by conveyance roller pairs 182 and 183 to the registration roller pair 117 and an image is formed on the back surface at the transfer nip. Then, the sheet S passes through the fixing roller pair 96 as described above to fix the image and is then discharged onto the sheet discharge tray 121 by the discharge roller pair 120.

Driving Structure of Switching Member

Figure 3:
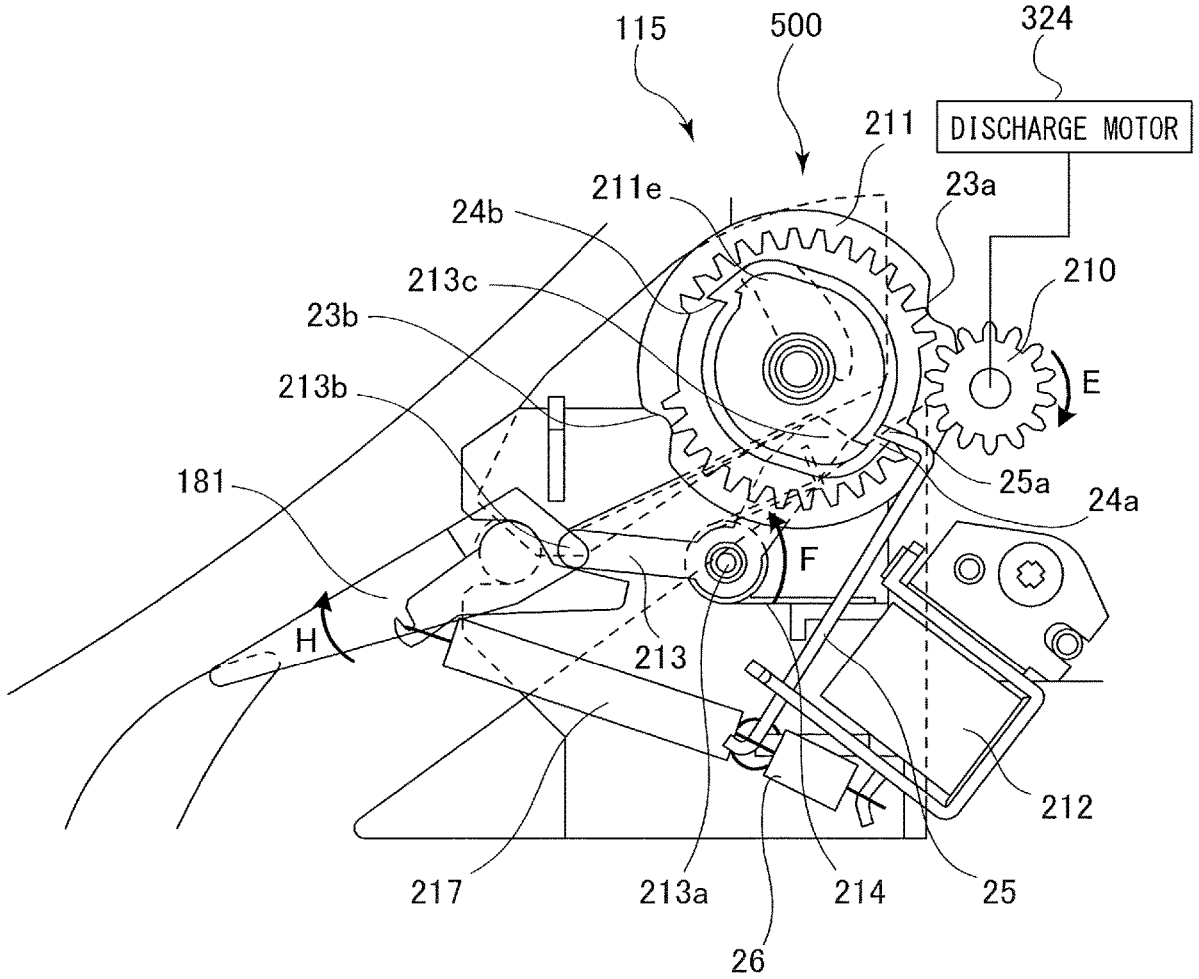
FIG. 3 is a section view illustrating a discharge unit.

Next, a driving structure of the switching member 181 will be described in detail. As illustrated in FIG. 3, the sheet discharge unit 115 includes an input gear 210, a tooth-missing gear 211, a switching solenoid 212, a link member 213 and the switching member 181. The input gear 210, the tooth-missing gear 211, the switching solenoid 212 and the link member 213 compose a transmission unit 500 for transmitting rotations of the sheet discharge motor 324 to the switching member 181. The input gear 210 rotates in a direction of an arrow E by a driving force of the sheet discharge motor 324 serving as a driving motor.

Figure 4A:
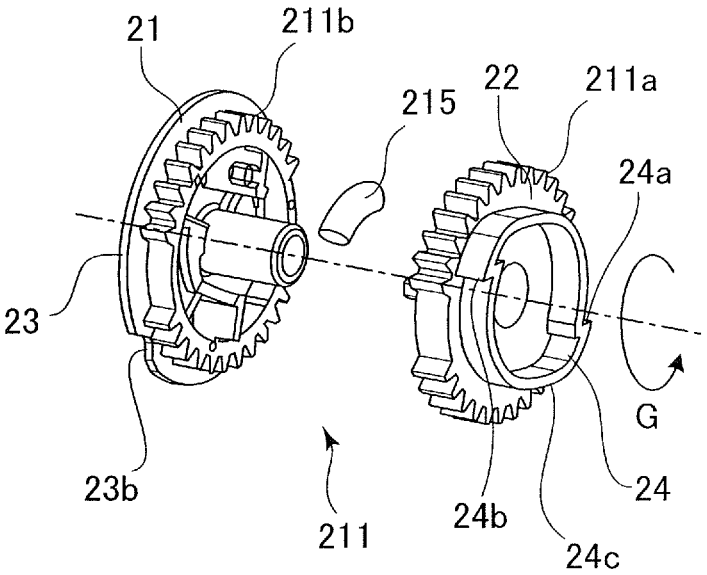
FIG. 4A is an exploded perspective view illustrating a tooth-missing gear.
Figure 4B:
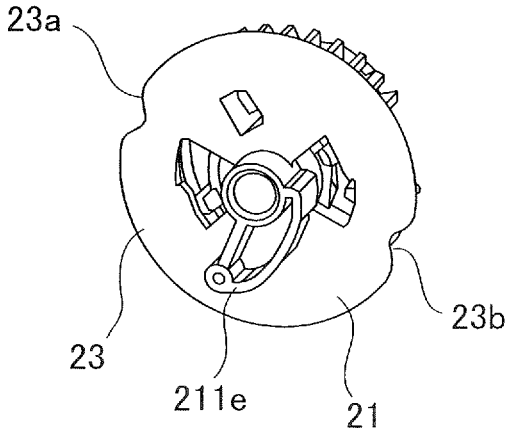
FIG. 4B is a perspective view illustrating a base portion.

As illustrated in FIG. 4A, the tooth-missing gear 211 includes a base portion 21, an actuating portion 22 and a compression spring 215 and in which the base portion 21 and the actuating portion 22 are coaxially disposed. As illustrated in FIGS. 4A and 4B, the base portion 21 includes a first gear 211*b* having two tooth-missing portions, a flange 23 and a cam 211*e*. The flange 23 is provided with recesses 23*a* and 23*b* defined at two places where a phase is different by 180 degrees. The base portion 21 is restricted from rotating as a tip portion 219*d* of a stopper member 219 (see FIG. 5) described later enters either one of these recesses 23*a* and 23*b*.

The actuating portion 22 includes a second gear 211*a* having two tooth-missing portions and an engage portion 24. The engage portion 24 is provided with claws 24*a* and 24*b* at two places where a phase is different by 180 degrees and a slide portion 24*c* formed between the claws 24*a* and 24*b*. The compression spring 215 is provided between the base portion 21 and the actuating portion 22 and urges so as to rotate the actuating portion 22 in a direction of an arrow G with respect to the base portion 21 that is restricted from rotating by the stopper member 219 (see FIG. 5).

As illustrated in FIG. 3, the switching solenoid 212 can move a claw member 25 while resisting against an urging force of a tensile spring 26 as a plunger not illustrated moves forward/backward when the switching solenoid 212 is energized. Specifically, in a condition in which the switching solenoid 212 is not energized, a tip portion 25*a* of the claw member 25 engages with the claw portion 24*a* of the tooth-missing gear 211 by the urging force of the tensile spring 26. When the switching solenoid 212 is energized, the claw member 25 is pressed by the plunger of the switching solenoid 212 and the tip portion 25*a* is spaced away from the claw portion 24*a* by resisting against the urging force of the tensile spring 26.

Figure 5:
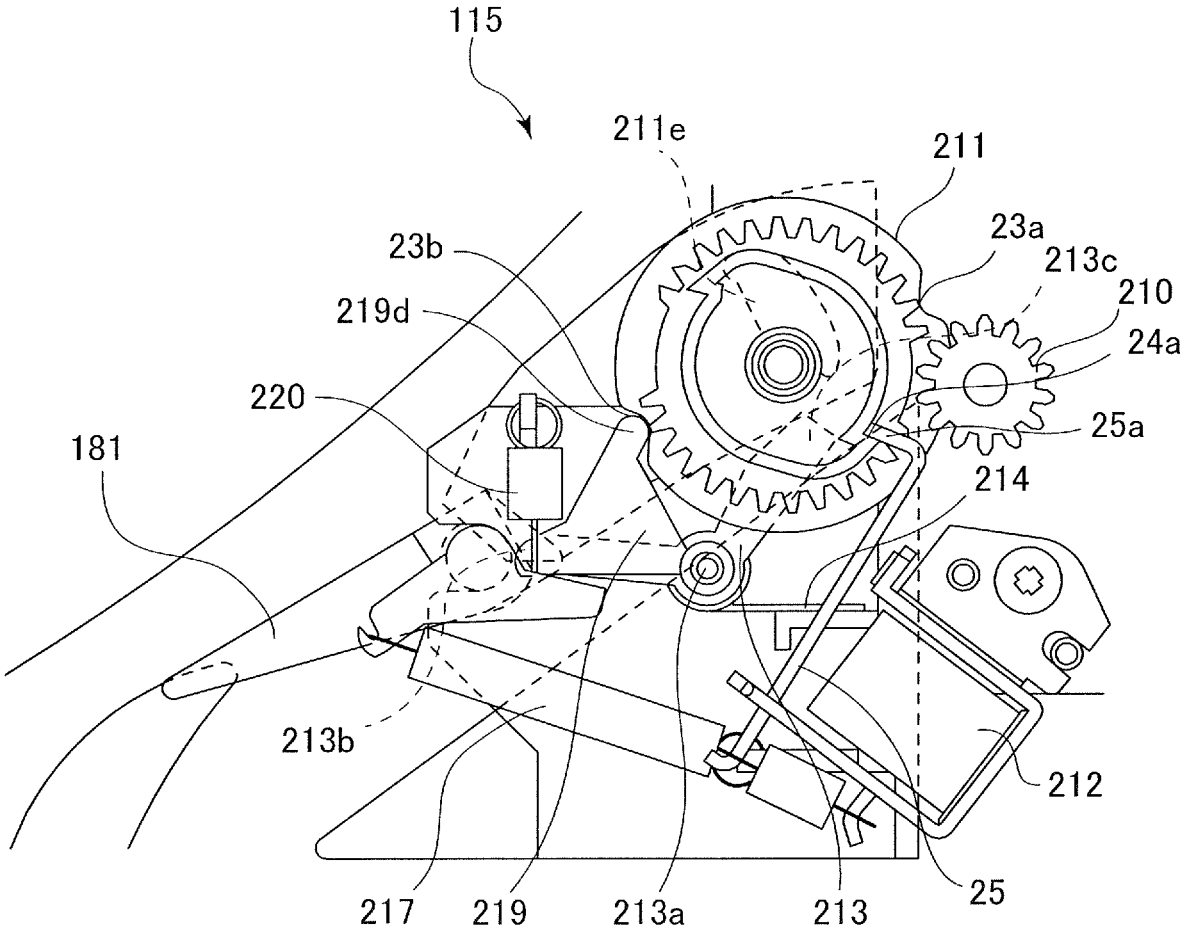
FIG. 5 is a section view illustrating the sheet discharge unit in a condition in which a switching solenoid is not energized.

As illustrated in FIGS. 3 and 5, the link member 213 is supported so as to be pivotable centering on a pivot shaft 213*a*, in which one end 213*b* thereof is abuttable with the switching member 181 and another end 213*c* is abuttable with a cam 211*e* of the tooth-missing gear 211. As illustrated in FIG. 5, the other end portion 213*c* of the link member 213 is spaced away from the cam 211*e* in a condition in which the tip portion 219*d* of the stopper member 219 enters the recess 23*b* and the tip portion 25*a* of the claw member 25 engages with the claw portion 24*a*. The link member 213 is also urged in the direction of F (see FIG. 3) by a torsion coil spring 214, and the stopper member 219 is urged such that the tip portion 219*d* enters the recess 23*b* by a tensile spring 220. Note that the stopper member 219 is offset with respect to the switching member 181 in an axial direction of the pivot shaft 213*a* and does not come into contact with the switching member 181. Still further, the stopper member 219 is supported relatively pivotably with respect to the link member 213.

The switching member 181 is urged counterclockwise by a tensile spring 217, and an urging force of the torsion coil spring 214 is set to be stronger than the urging force of the tensile spring 217. That is, the tensile spring 217, serving as an urging member, urges the switching member 181 toward the second position. Therefore, as illustrated in FIG. 3, the switching member 181 is held while being swung up in a direction of an arrow H by the link member 213 by resisting against the urging force of the tensile spring 217 in a condition in which the tip portion 25*a* of the claw member 25 engages with the claw portion 24*a*.

Operation of Switching Member

Next, an operation of the switching member 181 will be described. As illustrated in FIGS. 3 and 5, in a condition in which the tip portion 219*d* of the stopper member 219 enters the recess 23*b* and the tip portion 25*a* of the claw member 25 engages with the claw portion 24*a*, the link member 213 is spaced away from the cam 211*e*. Therefore, the link member 213, serving as a pressing member, urged by the torsion coil spring 214 presses the switching member 181 against the urging force of the tensile spring 217, and the switching member 181 is held at the first position. At this time, the tooth-missing portions of the first gear 211*b* and the second gear 211*a* face the input gear 210, so that no driving force is transmitted from the input gear 210 to the tooth-missing gear 211. Still further, the sheet discharge motor 324 always rotates and the input gear 210 also rotates in a condition in which a job is inputted.

Figure 6:
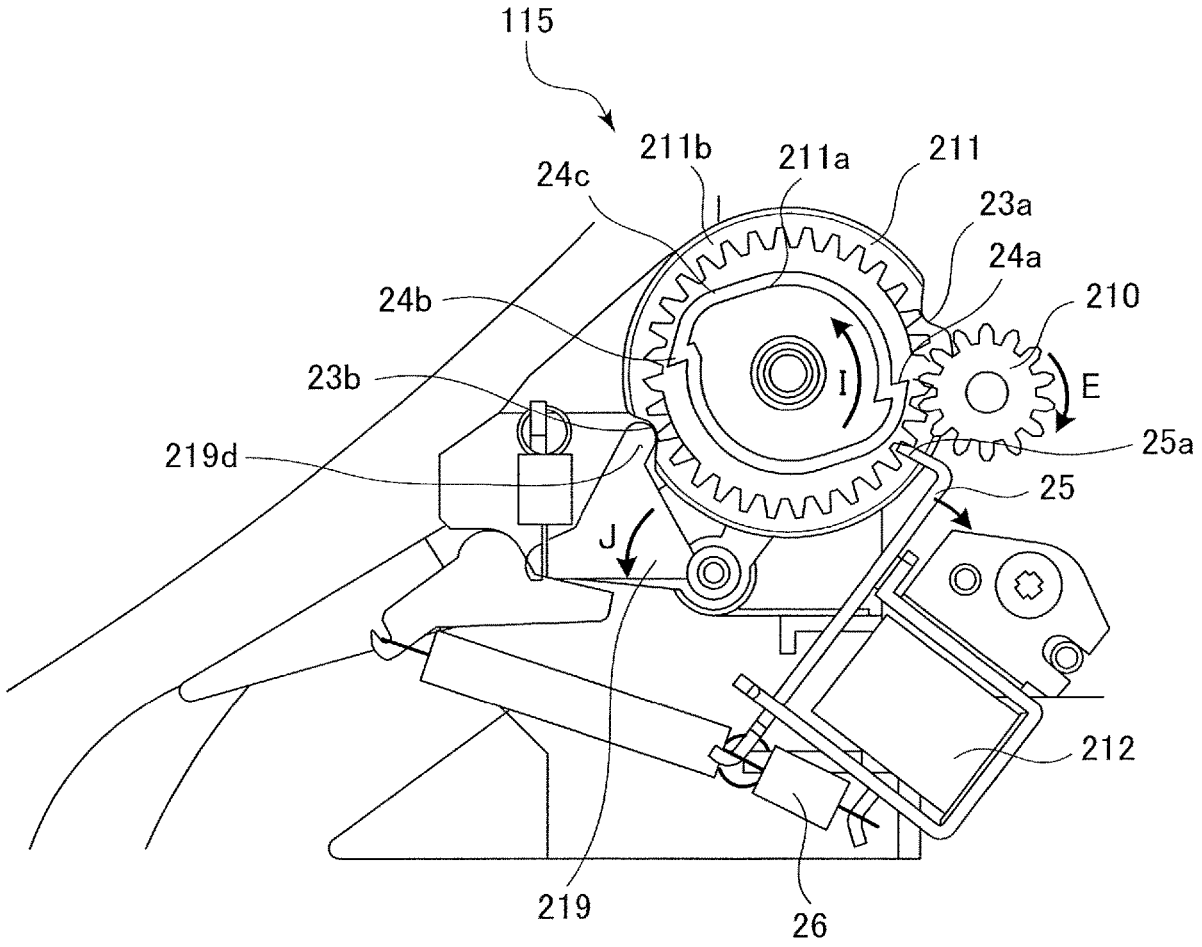
FIG. 6 is a section view illustrating the sheet discharge unit in a condition in which the switching solenoid is energized.

If the switching solenoid 212 is energized in this condition, the claw member 25 is pulled and the tip portion 25*a* of the claw member 25 is spaced away from the claw portion 24*a* of the tooth-missing gear 211 as illustrated in FIG. 6. At this time, because the base portion 21 of the tooth-missing gear 211 (see FIG. 4) is restricted from rotating by the stopper member 219, the actuating portion 22 rotates by the urging force of the compression spring 215 with respect to the base portion 21 being stopped. When the actuating portion 22 rotates by a predetermined amount, the gear portion of the first gear 211*a* of the actuating portion 22 engages with the input gear 210, so that the actuating portion 22 rotates. Because the actuating portion 22 is connected with the base portion 21 through the compression spring 215, the base portion 21 starts to rotate in a direction of an arrow I together with the actuating portion 22 at a moment of time when the actuating portion 22 rotates by a predetermined angle.

As the base portion 21 rotates, the engagement of the recess 23*b* with the tip portion 219*d* of the stopper member 219 is released and the stopper member 219 pivots in a direction of an arrow J. Meanwhile, because the switching solenoid 212 is energized temporarily, the claw member 25 is urged by the urging force of the tensile spring 26 to an axial center side of the tooth-missing gear 211 when the switching solenoid 212 is turned OFF. Thereby, the tip portion 25*a* of the claw member 25 slides with the slide portion 24*c* that rotates in a direction of an arrow I.

When the actuating portion 22 of the tooth-missing gear 211 rotates by 180 degrees, the tip portion 25*a* of the claw member 25 is locked by the claw portion 24*b* of the actuating portion 22 and the actuating portion 22 stops to rotate. Behind the actuating portion 22, the base portion 21 also stops to rotate as the tip portion 219*d* of the stopper member 219 enters the recess 23*a* of the base portion 21. At this time, the tooth-missing portions of the first gear 211*b* of the base portion 21 and the second gear 211*a* of the actuating portion 22 face the input gear 210, so that no driving force is inputted from the input gear 210 to the tooth-missing gear 211.

Figure 7A:
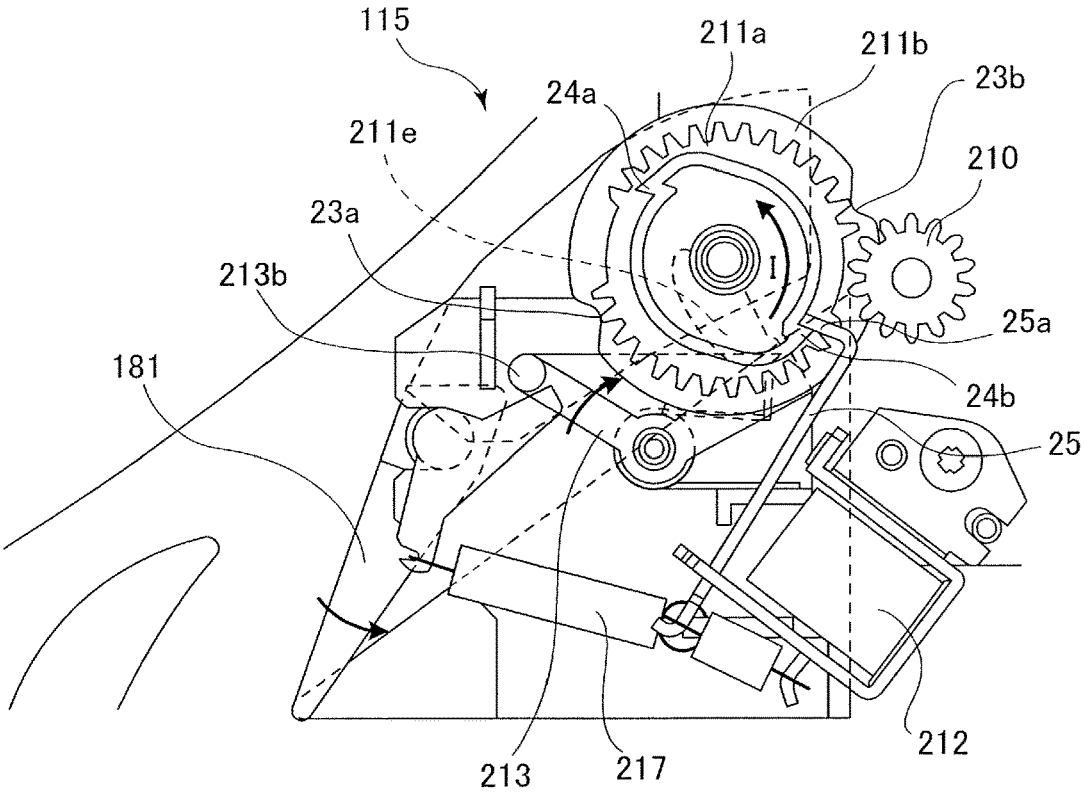
FIG. 7A is a section view illustrating the sheet discharge unit in a condition in which the switching member is located at a second position.

Still further, as illustrated in FIG. 7A, the link member 213 pivots clockwise by being pressed by the cam 211*e* provided in the base portion 21. Thereby, the one end portion 213*b* of the link member 213 moves in a direction of being spaced away from the switching member 181, so that the switching member 181 pivots from the first position to the second position by the urging force of the tensile spring 217.

Figure 7B:
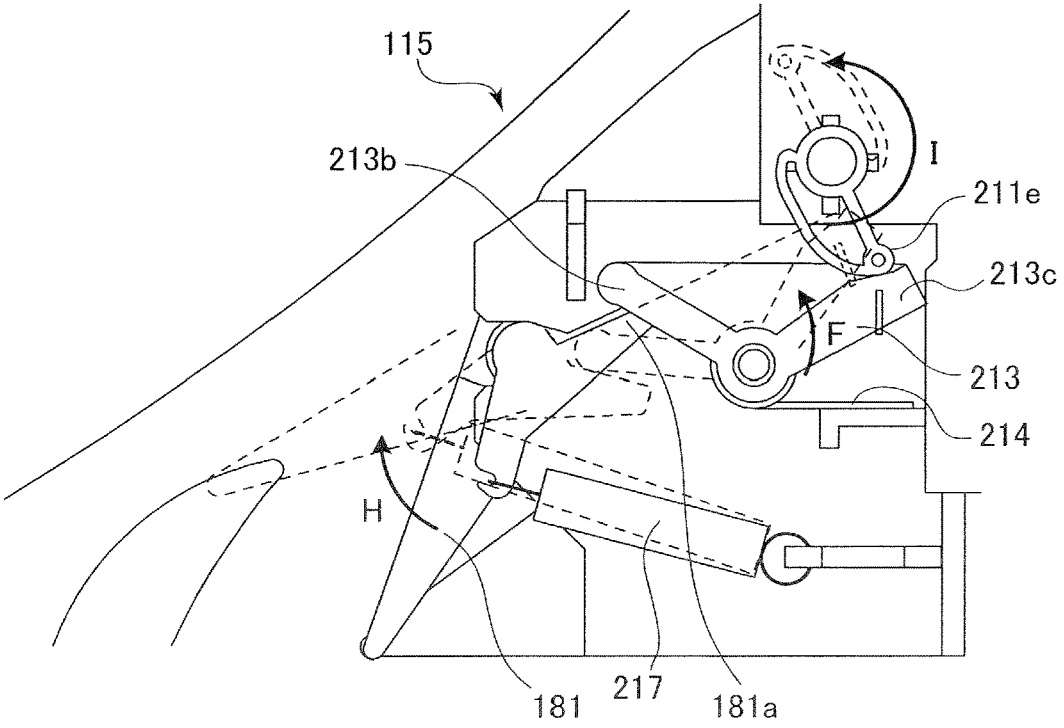
FIG. 7B is a section view illustrating a part where the switching member abuts with a link member.

When the switching solenoid 212 is energized again, the tooth-missing gear 211 starts to rotate in the direction of the arrow I and the cam 211*e* is spaced away from the other end portion 213*c* of the link member 213 as illustrated in FIG. 7B. Then, the link member 213 pivots in the direction of the arrow F by the urging force of the torsion coil spring 214. Thereby, the one end portion 213*b* of the link member 213 presses the switching member 181, and the switching member 181 pivots in a direction of an arrow H from the second position to the first position while resisting against the urging force of the tensile spring 217. Thus, the switching member 181 switches over between the first and second positions every time when the switching solenoid 212 is energized.

Operating Sound of Switching Member

Next, an operating sound of the switching member 181 will be described. In the case where the switching member 181 pivots from the second position to the first position, the switching member 181 pivots in the direction of the arrow H in linkage with the pivot of the link member 213 as illustrated in FIG. 7B. A force (inertia) of pivoting the switching member 181 in the direction of the arrow H acts also after when the link member 213 stops to pivot by inertia. Still further, because the switching member 181 is urged by the tensile spring 217, a force, i.e., an urging force, of pivoting the switching member 181 in an inverse direction of the direction of the arrow H also acts on the switching member 181. If the inertia force is stronger than the urging force, a bound phenomenon of repeating abutments and separation occurs between the one end portion 213*b* of the link member 213 and the switching member 181, thus generating the operating sound of the switching member 181.

In the case where the switching member 181 pivots from the first position to the second position, the switching member 181 pivots in a direction inverse to direction of the arrow H in linkage with the pivot of the link member 213 in the direction of the arrow F inverse to the direction of the arrow H. At this time, if a pivoting speed of the link member 213 is faster than a pivoting speed of the switching member 181, the one end portion 213*b* of the link member 213 is spaced away from the switching member 181. When the switching member 181 comes into contact with the one end portion 213*b* of the link member 213 after the link member 213 has stopped, the bound phenomenon by which the one end portion 213*b* of the link member 213 and the switching member 181 repeat the abutment and the separation occurs, thus generating the operating sound of the switching member 181.

Here, it is conceivable to paste a muffling member such as sponge between the one end portion 213*b* of the link member 213 and the switching member 181 to reduce the operating sound of the switching member 181. However, it is difficult to assure an area for pasting the muffling member on the one end portion 213*b* of the link member 213 and the switching member 181 and it is also difficult to paste the muffling member if durability thereof is taken into consideration. It is also conceivable to suppress the bound phenomenon by increasing the urging force of the tensile spring 217. However, if the urging force of the tensile spring 217 increases, it is also necessary to increase the urging force of the torsion coil spring 214. Then, torque necessary for rotating the tooth-missing gear 211 increases, thus increasing a size of the sheet discharge motor 324 for driving the input gear 210 and costs.

Hardware Structure

Figure 8:
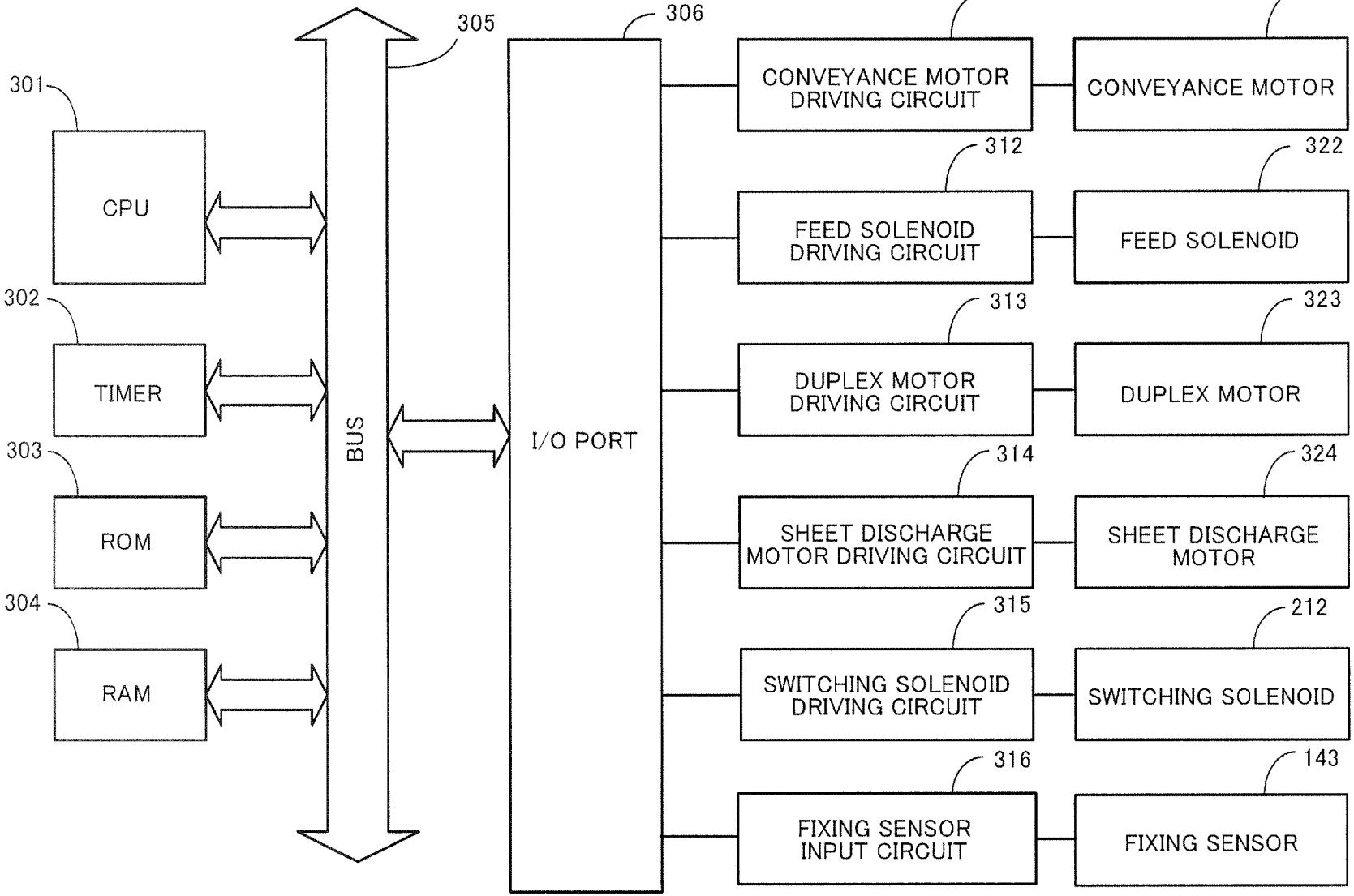
FIG. 8 is a block diagram illustrating a hardware structure of a printer control unit.

FIG. 8 is a hardware structural diagram of the printer control unit 400 (see FIG. 9) of the present embodiment. A CPU 301, a timer 302, a ROM 303, a RAM 304 and an I/O port 306 are connected through a bus 305. The CPU 301 serving as a control portion controls each actuator and the like of the printer 100. The timer 302 counts time to calculate timing when the CPU 301 is to issue a command. The ROM 303 stores programs for controlling the printer 100. The RAM 304 stores temporary data and the like. The I/O port 306 is connected with a conveyance motor driving circuit 311, a feed solenoid driving circuit 312, a duplex motor driving circuit 313, a sheet discharge motor driving circuit 314, a switching solenoid driving circuit 315 and a fixing sensor input circuit 316. These circuits are connected with the conveyance motor 321, the feed solenoid 322, the duplex motor 323, the sheet discharge motor 324, the switching solenoid 212 and the fixing sensor 143, respectively.

The CPU 301 operates the I/O port 306 through the bus 305 to drive the respective motors and solenoids. The CPU 301 also confirms logics of the fixing sensor 143 by confirming logics of the I/O port 306 through the bus 305.

Control Block

Figure 9:
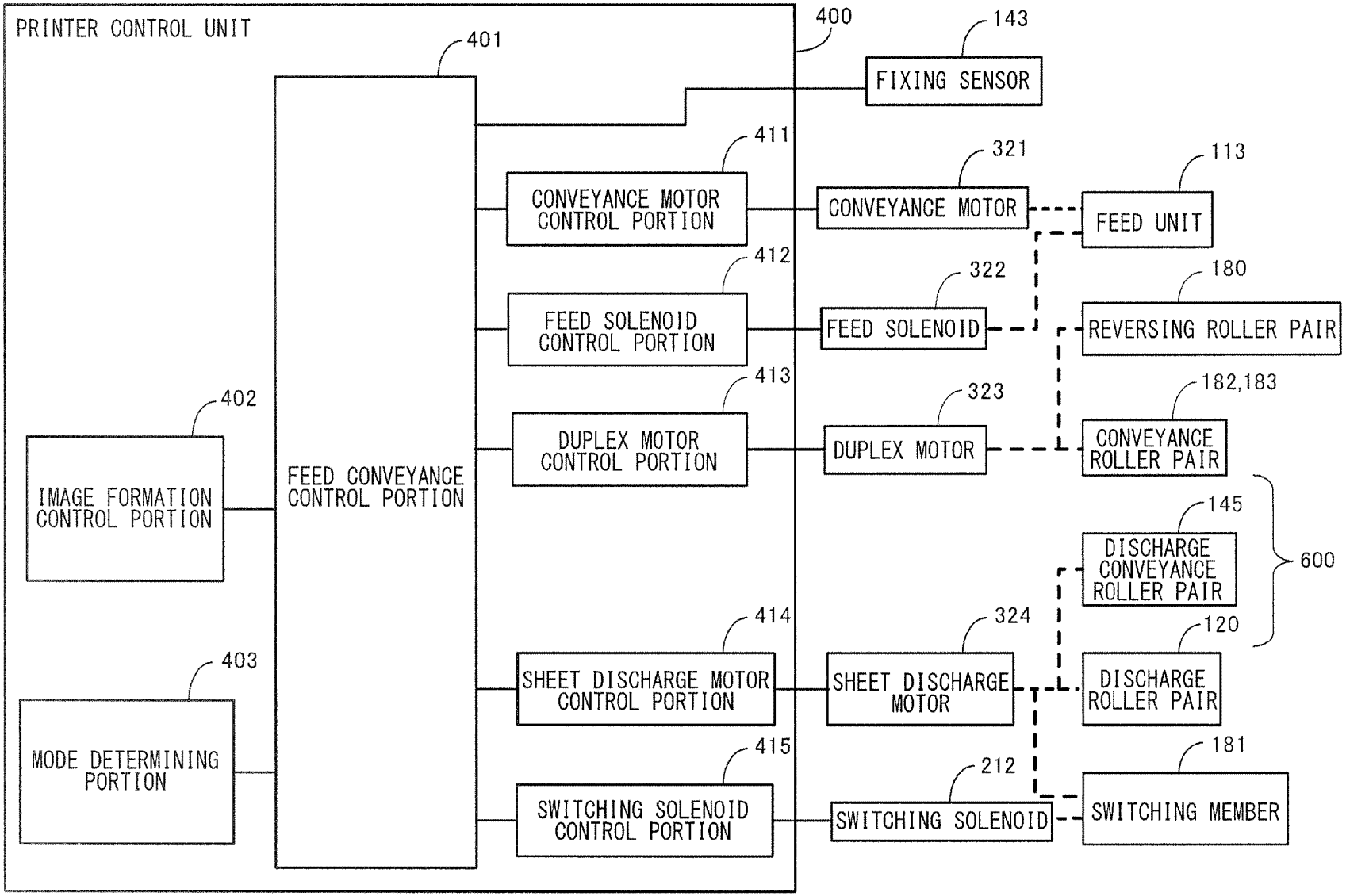
FIG. 9 is a block diagram illustrating a functional block structure of the printer control unit.

FIG. 9 is a block diagram illustrating a functional block structure of the printer control unit 400 of the present embodiment. The printer control unit 400 is composed of the CPU 301, the ROM 303, the RAM 304 and the gate elements described in FIG. 8. Functionally, the printer control unit 400 includes a feed conveyance control portion 401, an image formation control portion 402, a mode determining portion 403, a conveyance motor control portion 411 and a feed solenoid control portion 412. The printer control unit 400 further includes a duplex motor control portion 413, a sheet discharge motor control portion 414 and a switching solenoid control portion 415.

The feed conveyance control portion 401 issues commands to the respective motor control portions and solenoid control portions by cooperating with the image formation control portion 402 and the mode determining portion 403 based on information from the fixing sensor 143 and others. The image formation control portion 402 mainly controls processes in forming an image onto the intermediate transfer belt 112. The mode determining portion 403 determines an operation mode of the printer 100 instructed from an operation panel not illustrated or an external personal computer connected to the printer and an operation mode of the switching member 181 from a conveyance condition of the sheet acquired from the feed conveyance control portion 401.

The conveyance motor control portion 411 controls the conveyance motor 321 based on a command from the feed conveyance control portion 401. The feed solenoid control portion 412 controls the feed solenoid 322 based on a command from the feed conveyance control portion 401. The conveyance motor 321 and the feed solenoid 322 drive the rollers of the sheet feed unit 113. The duplex motor control portion 413 controls the duplex motor 323 based on a command from the feed conveyance control portion 401. The duplex motor 323 drives the reversing roller pair 180 and the conveyance roller pairs 182 and 183.

The sheet discharge motor control portion 414 controls the sheet discharge motor 324 based on a command from the feed conveyance control portion 401. The switching solenoid control portion 415 controls the switching solenoid 212 based on a command from the feed conveyance control portion 401. The sheet discharge motor 324 drives the sheet discharge conveyance roller pair 145 and the discharge roller pair 120. These sheet discharge conveyance roller pair 145 and the discharge roller pair 120 compose the conveyance portion 600. The driving force of the sheet discharge motor 324 is transmitted to the switching member 181 as described above by energizing the switching solenoid 212 in the condition in which the sheet discharge motor 324 is rotated.

Sheet Conveyance Control

Figure 10:
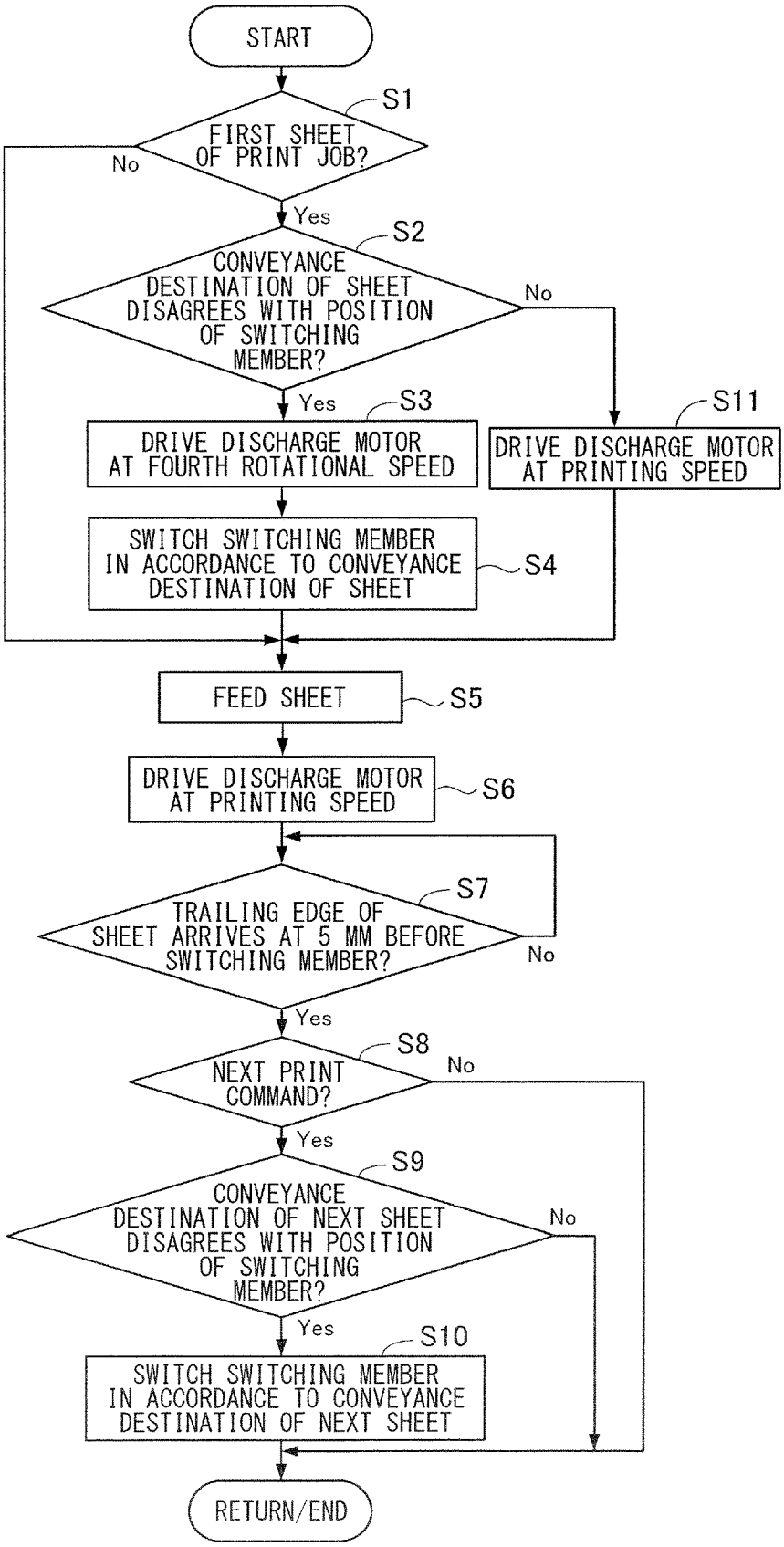
FIG. 10 is a flowchart illustrating a sheet conveyance control of the first embodiment.

Next, the sheet conveyance control of the printer 100 will be described along a flowchart in FIG. 10. In a case where a print job as a job for conveying a plurality of sheets is inputted, the CPU 301 (see FIG. 8) executes the sheet conveyance control including steps in FIG. 10. Each of the steps in FIG. 10 is executed on each sheet and is executed on each of a front surface and a back surface of a sheet in case of duplex printing.

Firstly, the CPU 301 judges whether a sheet to be fed from now on is a first sheet in the inputted print job in Step S1. Note that the first sheet of the print job will be referred to as a first sheet hereinafter. Still further, while processes of Steps S5 to S10 are executed not only on the first sheet but also on a second sheet and thereafter of the print job, the processes of the first sheet will be mainly described in the following description.

In a case where the sheet to be fed from now on is the first sheet, i.e., Yes in Step S1, the CPU 301 judges whether a conveyance destination of the first sheet agrees with a position of the switching member in Step S2. That is, the CPU 301 judges whether it is necessary to switch over the conveyance destination of the sheet in Step S2. For instance, in a case where the conveyance destination of the first sheet is the reverse conveyance path 202 even though the switching member 181 is located at the first position, i.e., the position indicated by the solid line in FIG. 2, the CPU 301 determines that it is necessary to switch over the conveyance destination of the sheet. Still further, in a case where the CPU 301 judges that the sheet to be fed in Step S1 is the second sheet or thereafter in the print job, i.e., No in Step S1, the process advances to Step S5 described later.

In the case where the conveyance destination of the first sheet disagrees with the position of the switching member 181, i.e., Yes in Step S2, as described above, the CPU 301 drives the sheet discharge motor 324 at a fourth speed in Step S3. Here, the sheet discharge motor 324 has four types of speeds from a first speed to the fourth speed as printing speeds in the present embodiment. The speed of the sheet discharge motor 324 is fastest in the first speed and becomes slower in order of a second speed, a third speed and the fourth speed. The respective motors for conveying the sheet other than the sheet discharge motor 324 have speeds corresponding to each printing speed. While the sheet discharge motor 324 has the four types of printing speeds in the present embodiment, the sheet discharge motor 324 may have printing speeds of four or more types.

The printing speed may be automatically determined in accordance to attributes of the sheet such as a type, a size and surface nature, or a user may manually determine. For instance, in a case where the sheet is a plain sheet or a thin sheet, preferably the printing speed is set to be the first speed and in a case where the sheet is a thick sheet, preferably the printing speed is set to be anyone of the second through fourth speeds.

Then, the CPU 301 energizes the switching solenoid 212 in the condition in which the sheet discharge motor 324 rotates to pivot the switching member 181 to switch over the conveyance destination of the first sheet in Step S4. Such operation of pivoting the switching member 181 from either one of the first and second positions to the other of the first and second positions will be called as a "pivot operation" hereinafter. Because the first sheet is not fed yet in Steps S3 and S4, there exists no sheet in the sheet discharge conveyance roller pair 145 and the discharge roller pair 120. Therefore, even if the sheet discharge motor 324 is driven at the fourth speed which is different from the printing speed, there will be no influence on the conveyance of the sheet.

An operating speed in the pivot operation of the switching member 181 depends on the speed of the sheet discharge motor 324 in Step S4. For instance, in a case where the sheet discharge motor 324 rotates at a first rotational speed, e.g., the first speed, the switching member 181 pivotally operates at a first operating speed. In a case where the sheet discharge motor 324 rotates at a second rotational speed, e.g., the fourth speed, which is slower than the first rotational speed, the switching member 181 pivotally operates at a second operating speed which is slower than the first operating speed. Therefore, in Step S4, the switching member 181 pivotally operates at relatively low speed corresponding to the sheet discharge motor 324 that drives at the fourth speed.

This arrangement makes it possible to moderate the impact between the switching member 181 and the link member 213, to mitigate the bound phenomenon between the switching member 181 and the link member 213, and to reduce the operating sound of the switching member 181 without dropping productivity of the printer 100. Note that although the sheet discharge motor 324 is driven at the fourth speed in Step S3, the sheet discharge motor 324 may be driven at another speed if it reduces the operating speed of the switching member 181.

Still further, a sheet conveyance speed of the sheet discharge conveyance roller pair 145 and the discharge roller pair 120 also depends on the speed of the sheet discharge motor 324 similarly to the switching member 181. For instance, in a case where the sheet discharge motor 324 rotates at a first rotational speed, e.g., the first speed, the sheet discharge conveyance roller pair 145 and the discharge roller pair 120 convey the sheet at a first conveyance speed. In a case where the sheet discharge motor 324 rotates with a second rotational speed, e.g., the fourth speed, which is slower than the first speed, the sheet discharge conveyance roller pair 145 and the discharge roller pair 120 convey the sheet at a second conveyance speed which is slower than the first conveyance speed.

After the switching member 181 has executed the pivot operation in Step S4, the CPU 301 drives the pickup roller 9 to feed the first sheet in Step S5. Specifically, the CPU 301 drives the pickup roller 9 by energizing the feed solenoid 322 while driving the conveyance motor 321 at the printing speed. Still further, in a case where it is not necessary to change the conveyance destination of the sheet in Step S2, i.e., No in Step S2, the CPU 301 drives the sheet discharge motor 324 at the printing speed to feed the first sheet in Steps S11 and S5.

Next, the CPU 301 drives the sheet discharge motor 324 at the printing speed in Step S6. Here, because the sheet discharge conveyance roller pair 145 is fully separated from the cassette 111, the speed of the sheet discharge motor 324 reaches the printing speed before a leading edge of the first sheet arrives at the sheet discharge conveyance roller pair 145.

Next, the CPU 301 judges whether a trailing edge of the first sheet has arrived at a position 5 mm before the switching member 181 in Step S7. At this time, the CPU 301 finds the position of the trailing edge of the first sheet by counting a time by the timer 302 (see FIG. 8) since when the fixing sensor 143 (see FIG. 1) provided between the fixing roller pair 96 and the sheet discharge conveyance roller pair 145 has detected the trailing edge of the first sheet.

In a case where the CPU 301 determines that the trailing edge of the first sheet has arrived at the position before 5 mm of the switching member 181, i.e., Yes in Step S7, the CPU 301 judges whether a print job of a next sheet is commanded in Step S8. In a case where the print job of the next job has been commanded, i.e., Yes in Step S8, the CPU 301 judges whether a conveyance destination of the next sheet disagrees with the position of the switching member 181 in Step S9.

In a case where the conveyance destination of the next sheet disagrees with the position of the switching member 181, i.e., Yes in Step S9, the CPU 301 energizes the switching solenoid 212 to cause the switching member 181 to execute the pivot operation in Step S10. This time is a time after the leading edge of the first sheet, i.e., a preceding sheet, has arrived at the switching member 181 and before the trailing edge of the first sheet passes through the switching member 181. Accordingly, the switching member 181 that executes the pivot operation comes into contact with the first sheet being conveyed. Thereby, it is possible to mitigate the bound phenomenon between the switching member 181 and the link member 213 and to reduce the operating sound of the switching member 181 as a result. Then, the process returns to Step S1.

Note that the timing for causing the switching member 181 to execute the pivot operation is not limited to the timing when the trailing edge of the first sheet arrives at the position 5 mm before the switching member 181. The timing for pivoting the switching member 181 may be appropriately set as long as the operating sound of the switching member 181 is reduced, the sheet is not damaged and the conveyance of the sheet is not affected.

Still further, in a case where there is no command to print the next sheet in Step S8, i.e., No in Step S8 and in a case where the conveyance destination of the next sheet agrees with the position of the switching member 181 in Step S9, i.e., No in Step S9, the CPU 301 stops the sheet conveyance control and returns to Step S1.

Because each process in the flowchart illustrated in FIG. 10 as described above is executed per sheet, the respective processes of Steps S1 through S10 are executed on each sheet in a case of the job of continuously conveying a plurality of sheets.

Figure 11:
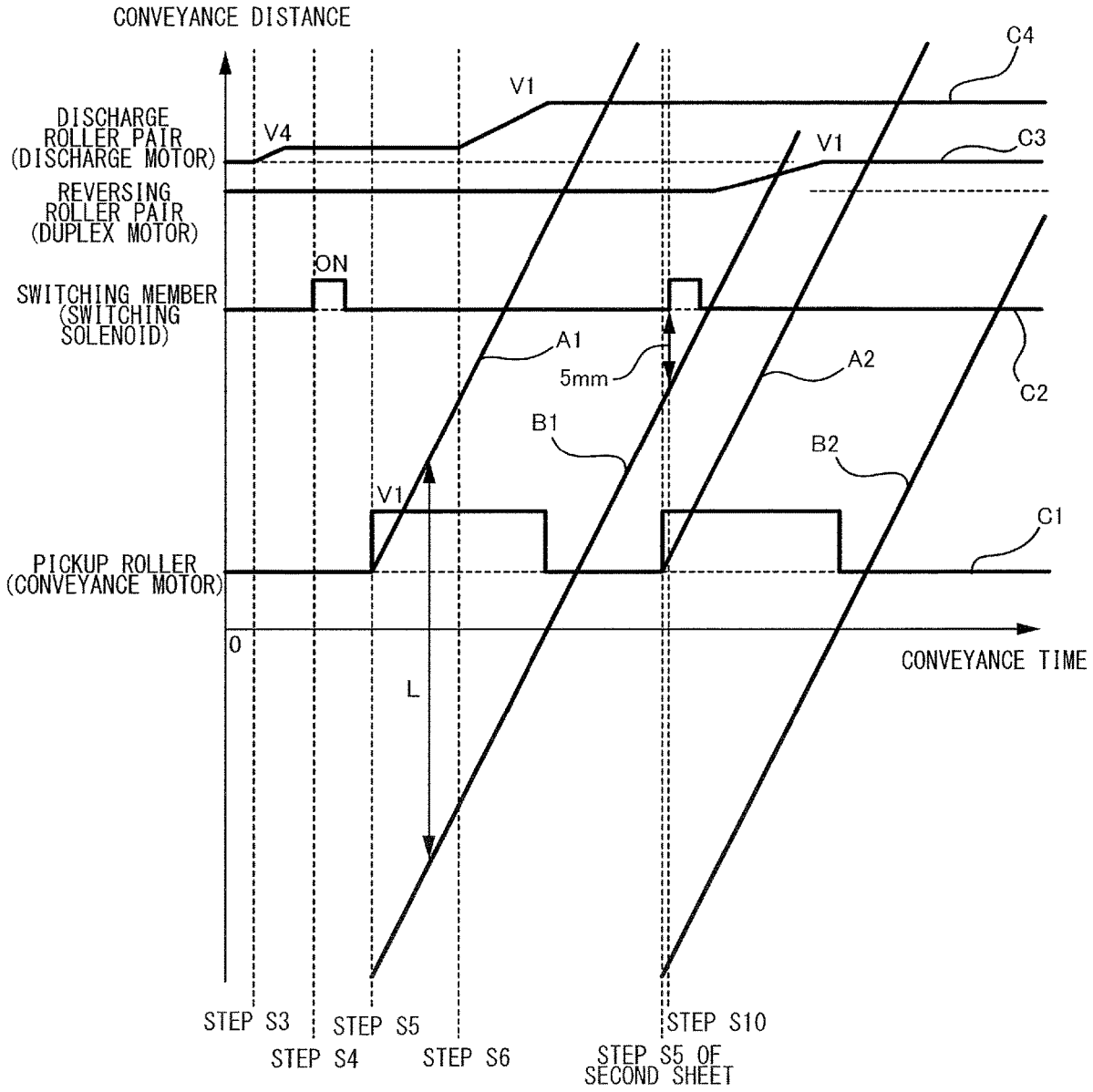
FIG. 11 is a timing chart in connection with first and second sheets.

FIG. 11 illustrates a timing chart in which a first sheet in a job of continuously conveying a plurality of sheets is set as a first sheet and a second sheet as a second sheet and leading edges and trailing edges of these first and second sheets are noticed for example. FIG. 11 illustrates an example in a case where the first sheet indicates a single-side printing to be executed and the second sheet indicates a double-side printing to be executed. That is, the first sheet is guided by the switching member 181 to the sheet discharge conveyance path 201 and the second sheet is guided by the switching member 181 to the reverse conveyance path 202.

In FIG. 11, signs A1 and B1 indicate positions of a leading edge and a trailing edge of the first sheet and signs A2 and B2 indicate positions of a leading edge and a trailing edge of the second sheet, respectively. A Sign L is a length in a sheet conveyance direction of the sheet. Straight lines C1 through C4 indicate ON/OFF and speed of the conveyance motor 321, the switching solenoid 212, the duplex motor 323 and the sheet discharge motor 324 respectively driving the pickup roller 9, the switching member 181, the reversing roller pair 180 and the discharge roller pair 120. Still further, the printing speed is set at the first speed (V1) and rotational speed of the sheet discharge motor 324 in pivotally operating the switching member 181 is set at the fourth speed (V4) in FIG. 11.

Firstly, the CPU 301 rotates the sheet discharge motor 324 at the fourth speed (V4) before feeding the first sheet and causes the switching member 181 to execute the pivot operation by energizing the switching solenoid 212 in Steps S3 and S4. At this time, because the switching member 181 pivots relatively at low speed corresponding to the fourth speed, this arrangement makes it possible to reduce the operating sound of the switching member 181. Then, the CPU 301 drives the conveyance motor 321 that determines the rotational speed of the pickup roller 9 at the first speed (V1) and drives the sheet discharge motor 324 at the first speed (V1) in Steps S5 and S6. The CPU 301 drives the conveyance motor 321 for a predetermined time and then stops.

Next, the CPU 301 drives the conveyance motor 321 at the first speed (V1) to feed the second sheet (Step S5 of the second sheet). Then, at the timing when the trailing edge of the first sheet arrives at the position 5 mm before the switching member 181, the CPU 301 energizes the switching solenoid 212 to cause the switching member 181 to execute the pivot operation in Step S10. At this time, while the switching member 181 pivots relatively at high speed because the sheet discharge motor 324 is driven at the first speed (V1), the switching member 181 comes into contact with the first sheet being conveyed. This arrangement makes it possible to mitigate the bound phenomenon between the switching member 181 and the link member 213 and to reduce the operating sound of the switching member 181 as a result.

Next, the CPU 301 drives the duplex motor 323 such that the reversing roller pair 180 reaches the first speed (V1) before the leading edge of the second sheet arrives at the reversing roller pair 180. As it is apparent from FIG. 11, the CPU 301 continuously rotates the sheet discharge motor 324 at the first speed until when the job is finished after when the sheet discharge motor 324 is set at the first speed (V1) to convey the first sheet. In other words, the CPU 301 continuously rotates the sheet discharge motor 324 at the first speed when the sheet of the second and thereafter is being conveyed. In a case of switching over a conveyance destination of a succeeding sheet and thereafter, e.g., the second sheet, the CPU 301 causes the switching member 181 to execute pivot operation so as to come into contact with a preceding sheet, e.g., the first sheet, preceding to the succeeding sheet. This arrangement also makes it possible to reduce the operating sound of the switching member 181 without dropping the productivity of the printer 100.

Second Embodiment

Next, while a second embodiment of the present disclosure will be described, the second embodiment is what the sheet conveyance control of the first embodiment is modified. Due to that, the second embodiment will be described by omitting illustrations or by denoting the same reference numerals in the drawings for the same components with those of the first embodiment.

The sheet conveyance control of the printer 100 of the second embodiment will be described along a flowchart in FIG. 12. In a case where a print job as a job for conveying a plurality of sheets is inputted, the CPU 301 (see FIG. 8) executes the sheet conveyance control including steps in FIG. 12. Each of the steps in FIG. 12 is executed on each sheet and is executed on each of a front surface and a back surface of a sheet in case of duplex printing.

Note that because Steps S1 through S6 and S11 in the flowchart in FIG. 12 are the same with those in the flowchart illustrated in FIG. 10, their description will be omitted. Still further, while processes of Steps S21 through S28 are conducted not only on the first sheet but also on a sheet of a second and thereafter of the print job, the processes conducted on the first sheet will be mainly described in the following description.

After executing Step S6, the CPU 301 advances the process to Step S21. The CPU 301 judges whether the trailing edge of the first sheet has passed through the discharge roller pair 120 in a case where the conveyance destination of the first sheet is the sheet discharge conveyance path 201 and judges whether the trailing edge has passed through the switching member 181 in a case where the conveyance destination is the reverse conveyance path 202 in Step S21. That is, the CPU 301 judges whether the productivity of the printer 100 is not affected even if the rotational speed of the sheet discharge motor 324 is changed.

In a case where the CPU 301 judges that the trailing edge of the sheet has passed through the discharge roller pair 120 or the switching member 181, i.e., Yes in Step S21, the CPU 301 judges whether printing on the next sheet is commanded in Step S22. In a case where printing on the next sheet is commanded, i.e., Yes in Step S22, the CPU 301 judges whether a conveyance destination of the next sheet disagrees with the position of the switching member 181 in Step S23.

In a case where the conveyance destination of the next sheet disagrees with the position of the switching member 181, i.e., Yes in Step S23, the CPU 301 drives the sheet discharge motor 324 at the fourth speed in Step S24. At this time, because no sheet exists in the sheet discharge conveyance roller pair 145 and the discharge roller pair 120, the productivity of the printer 100 is not affected even if the rotational speed of the sheet discharge motor 324 is changed to the fourth speed.

Next, the CPU 301 energizes the switching solenoid 212 to cause the switching member 181 to execute the pivot operation in a condition in which the trailing edge of the first sheet has passed through the switching member 181 in Step S25. At this time, because the switching member 181 pivotally operates relatively at low speed corresponding to the sheet discharge motor 324 that drives at the fourth speed, the link member 213 is also operated at low speed. This arrangement makes it possible to mitigate the bound phenomenon between the switching member 181 and the link member 213 and to reduce the operating sound of the switching member 181. Still further, because the trailing edge of the first sheet is passing through the switching member 181 when the switching member 181 pivotally operates, the first sheet will not come into contact with the switching member 181. This arrangement makes it possible to improve the conveyance and quality of the sheet. Next, the CPU 301 drives the sheet discharge motor 324 at the printing speed in Step S26 and returns to Step S1.

Note that while the sheet discharge motor 324 is driven at the fourth speed in Steps S3 and S24 in the present embodiment, the sheet discharge motor 324 may be set at a different speed if it enables to reduce the operating sound of the switching member 181.

In a case where no command to print the next sheet is issued in Step S22, i.e., No in Step S22, the CPU 301 finishes the sheet conveyance control and in a case where the conveyance destination of the next sheet agrees with the position of the switching member 181 in Step S23, i.e., No in Step S23, the CPU 301 returns the process to Step S1.

In a case where the CPU 301 judges that a sheet to be fed from now on is not a first sheet of the print job in Step S1, i.e., No in Step S1, the CPU 301 waits for a feed timing of such sheet in Step S27. After waiting for the feed timing, the sheet is fed by the pickup roller 9 in Step S28 and the process advances to Step S21.

Figure 13:
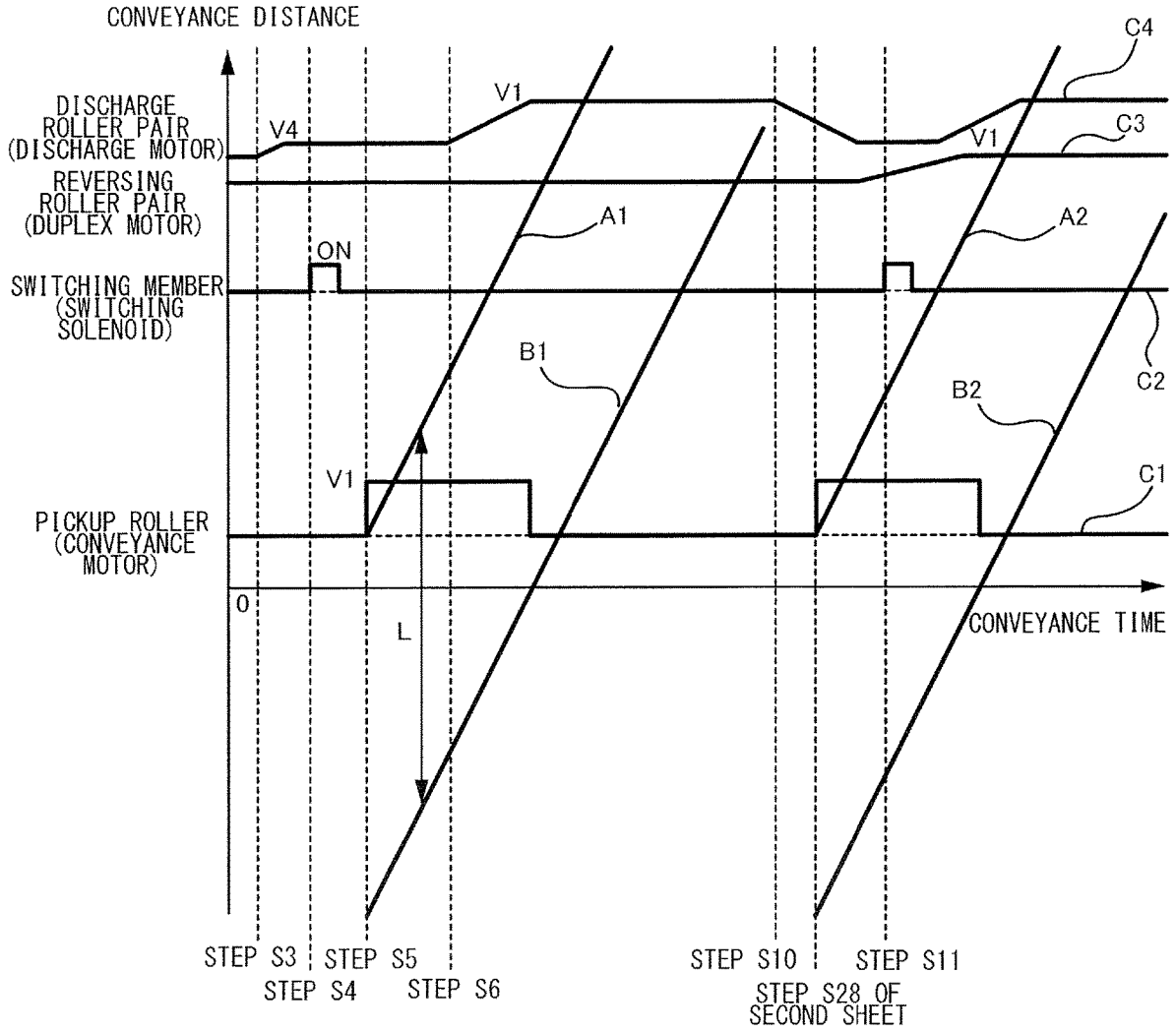
FIG. 13 is a timing chart in connection with the first and second sheets.

The feed timing of such succeeding sheet will be described with reference to a timing-chart in FIG. 13. FIG. 13 illustrates a case of executing processes in which the first sheet is a single side print and a second sheet succeeding to the first sheet is a double side print and in which the first sheet is guided by the switching member 181 to the sheet discharge conveyance path 201 and the second sheet is guided to the reverse conveyance path 202. Still further, the printing speed is set at the first speed (V1) and the rotational speed of the sheet discharge motor 324 in pivotally operating the switching member 181 is set at the fourth speed (V4) in FIG. 13. Note that because a timing chart on the first sheet is almost the same with that described in FIG. 11, its description will be omitted here.

A feed timing of the second sheet, i.e., Step S28 of the second sheet, will be described below. The feed timing of the second sheet requires the following conditions. That is, after causing the switching member 181 to pivotally operate while driving the sheet discharge motor 324 at the fourth speed (V4) for the first sheet, i.e., after Step S11, the rotational speed of the sheet discharge motor 324 is changed to the first speed V1 and then a leading edge of the second sheet is required to arrive at the discharge roller pair 120. In other words, the second sheet needs to arrive at the conveyance portion 600 after the conveyance portion 600 (see FIG. 9) including the sheet discharge conveyance roller pair 145 and the discharge roller pair 120 is enabled to convey the second sheet as the succeeding sheet at the first speed.

The second sheet can be conveyed at the conveyance speed corresponding to the first speed from the pickup roller 9 through the discharge roller pair 120 by feeding the second sheet under such conditions. Thereby, the conveyance speed of the sheet is not changed on the way of the conveyance path, enabling to reduce a skew and a jam of the sheet.

The sheet conveyance control of the present embodiment is executed in a case of preceding either one of image quality, conveyance of a sheet and the reduction of operating sound of the switching member 181 more than a number of prints per unit time through a command from a controller not illustrated. Still further, in a case of preceding the number of prints per unit time more than the image quality, the conveyance of a sheet and the reduction of operating sound of the switching member 181, the sheet conveyance control of the first embodiment is executed.

Note that the reduction effect of the operating sound of the switching member 181 is influenced by the rotational speed of the motor mounted on the printer 100 and a number of actuators operating simultaneously. That is, in a case where operating sound generated by the whole printer 100 is large, the operating sound of the switching member 181 becomes relatively inconspicuous. Meanwhile, if the operating sound generated from the whole printer 100 is small, the operating sound of the switching member 181 becomes relatively conspicuous.

Therefore, in a case where it is judged that the operating sound of the switching member 181 is conspicuous, the sheet conveyance control of the present embodiment may be executed. For instance, the sheet conveyance control of the present embodiment may be executed in printing at the first or second speeds and the sheet conveyance control of the first embodiment may be executed in printing at the third speed. Still further, in a case where there is a feed optional unit or a discharge optional unit connected with the printer 100, it is possible to judge whether the sheet conveyance control of the present embodiment is to be selected depending on presence of an operation of those units.

Specifically, in a case where the operation of switching over the conveyance destination of the second sheet serving as the succeeding sheet is set as a first mode and the operation of switching over the conveyance destination of the second sheet of the second embodiment is set as a second mode, it is possible to execute by selecting either one of the first and second modes. That is, the first mode includes the processes of Steps S6 through S10 in the flowchart in FIG. 10, and the second mode includes the processes of Steps S6 and S21 through S26 in the flowchart in FIG. 12.

Note that although the switching member 181 executes the pivot operation before the first sheet is fed in Step S4 in any embodiments described above, the present disclosure is not limited to this case. For instance, the switching member 181 may execute the pivot operation after when the first sheet is fed as long as it is a time before the first sheet arrives at the switching member 181, the sheet discharge conveyance roller pair 145 and the discharge roller pair 120.

Still further, while all of the embodiments described above have been described by using the full color electrophotographic printer 100, the present disclosure is not limited to such case. For instance, the present disclosure is applicable to a monochromatic electro-photographic image forming apparatus or an ink-jet type image forming apparatus configured to form an image on a recording material by discharging ink droplet from a nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-185895, filed Sep. 28, 2018, which is hereby incorporated by reference herein in its entirety.

What is claimed is:

1. A sheet conveyance apparatus comprising:

a switching member configured to be pivotable between a first position where the switching member guides a sheet to a first conveyance path and a second position where the switching member guides a sheet to a second conveyance path different from the first conveyance path;

a conveyance portion configured to convey the sheet;

a driving motor configured to drive the conveyance portion;

a transmission unit configured to transmit rotations of the driving motor to the switching member to cause the switching member to execute a pivot operation of pivoting from either one of the first and second positions to the other of the first and second positions; and a control portion configured to control the driving motor and the transmission unit, wherein the conveyance portion conveys the sheet at a first conveyance speed in a case where the driving motor rotates at a first rotational speed, and conveys the sheet at a second conveyance speed which is greater than zero and slower than the first conveyance speed in a case where the driving motor rotates at a second rotational speed which is greater than zero and slower than the first rotational speed, wherein the switching member executes the pivot operation at a first operating speed in a case where the transmission unit transmits the rotations of the driving motor rotating at the first rotational speed to the switching member, and executes the pivot operation ata second operating speed which is slower than the first operating speed in a case where the transmission unit transmits the rotations of the driving motor rotating at the second rotational speed to the switching member, and wherein, in a case where the control portion conveys a first sheet in a job at the first conveyance speed by the conveyance portion and causes the switching member to execute the pivot operation, the control portion causes the switching member to execute the pivot operation at the second operating speed before the first sheet arrives at the switching member and the conveyance portion, and rotates the driving motor at the first rotational speed after the pivot operation has been executed and before the first sheet arrives at the conveyance portion.

2. The sheet conveyance apparatus according to claim 1, wherein in a case where the control portion conveys sheets, including a preceding sheet and a succeeding sheet, at the first conveyance speed by the conveyance portion in a job where a plurality of sheets are conveyed continuously and switches a conveyance destination of the succeeding sheet from the first conveyance path to the second conveyance path, the control portion causes the switching member to execute the pivot operation at the first operating speed after a leading edge of the preceding sheet has arrived at the switching member and before a trailing edge of the preceding sheet passes through the switching member.

3. The sheet conveyance apparatus according to claim 2, wherein the control portion continuously rotates the driving motor at the first rotational speed in a case where each sheet after a first sheet in the job is being conveyed.

4. The sheet conveyance apparatus according to claim 1, wherein in a case where the control portion conveys sheets, including a preceding sheet and a succeeding sheet, at the first conveyance speed by the conveyance portion in a job where a plurality of sheets are conveyed continuously and switches a conveyance destination of the succeeding sheet from the first conveyance path to the second conveyance path, the control portion causes the switching member to execute the pivot operation at the second operating speed after a trailing edge of the preceding sheet has passed through the switching member.

5. The sheet conveyance apparatus according to claim 4, wherein the control portion controls a conveyance timing of the succeeding sheet such that the succeeding sheet arrives at the conveyance portion after the conveyance portion has been enabled to convey the succeeding sheet at the first conveyance speed.

6. The sheet conveyance apparatus according to claim 1, wherein the control portion configured to execute, in a case where the control portion conveys sheets, including a preceding sheet and a succeeding sheet, at the first conveyance speed by the conveyance portion in a job where a plurality of sheets are conveyed continuously and switches a conveyance destination of the succeeding sheet from the first conveyance path to the second conveyance path, a first mode of causing the switching member to execute the pivot operation at the first operating speed after a leading edge of the preceding sheet has arrived at the switching member and before a trailing edge of the preceding sheet passes through the switching member, and a second mode of causing the switching member to execute the pivot operation at the second operating speed after the trailing edge of the preceding sheet has passed through the switching member.

7. The sheet conveyance apparatus according to claim 1, wherein the conveyance portion comprises a sheet discharge roller pair disposed downstream of the switching member in a sheet conveyance direction and discharging the sheet out of the sheet conveyance apparatus.

8. The sheet conveyance apparatus according to claim 7, wherein the conveyance portion comprises a conveyance roller pair disposed upstream of the switching member in the sheet conveyance direction and conveying the sheet toward the switching member.

9. The sheet conveyance apparatus according to claim 1, further comprising an urging member configured to urge the switching member toward the second position.

10. The sheet conveyance apparatus according to claim 9, wherein the transmission unit comprises a pressing member that pivots the switching member toward the first position against an urging force of the urging member by pressing the switching member.

11. An image forming apparatus comprising:

a switching member configured to be pivotable between a first position where the switching member guides a sheet to a first conveyance path and a second position where the switching member guides a sheet to a second conveyance path different from the first conveyance path;

a conveyance portion configured to convey the sheet;

a driving motor configured to drive the conveyance portion;

a transmission unit configured to transmit rotations of the driving motor to the switching member to cause the switching member to execute a pivot operation of pivoting from either one of the first and second positions to the other of the first and second positions;

a control portion configured to control the driving motor and the transmission unit; and an image forming unit configured to form an image on the sheet, wherein the conveyance portion conveys the sheet at a first conveyance speed in a case where the driving motor rotates at a first rotational speed and conveys the sheet at a second conveyance speed which is greater than zero and slower than the first conveyance speed in a case where the driving motor rotates at a second rotational speed which is greater than zero and slower than the first rotational speed, wherein the switching member executes the pivot operation at a first operating speed in a case where the transmission unit transmits the rotations of the driving motor rotating at the first rotational speed to the switching member, and executes the pivot operation ata second operating speed which is slower than the first operating speed in a case where the transmission unit transmits the rotations of the driving motor rotating at the second rotational speed to the switching member, and wherein, in a case where the control portion conveys a first sheet in a job at the first conveyance speed by the conveyance portion and causes the switching member to execute the pivot operation, the control portion causes the switching member to execute the pivot operation at the second operating speed before the first sheet arrives at the switching member and the conveyance portion, and rotates the driving motor at the first rotational speed after the pivot operation has been executed and before the first sheet arrives at the conveyance portion.

* * * * *